US007963128B2

(12) United States Patent
Lee et al.

(10) Patent No.: US 7,963,128 B2
(45) Date of Patent: Jun. 21, 2011

(54) APPARATUS AND METHOD FOR SENSING VIBRATION OF WASHING MACHINE

(75) Inventors: Sang-Hoon Lee, Seoul (KR); Deok-Kyu Kim, Incheon (KR); Tae-Hee Lee, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 653 days.

(21) Appl. No.: 11/856,974

(22) Filed: Sep. 18, 2007

(65) Prior Publication Data

US 2008/0066238 A1 Mar. 20, 2008

(30) Foreign Application Priority Data

Sep. 19, 2006 (KR) ..... 10-2006-0090830

(51) Int. Cl.
*D06F 33/02* (2006.01)

(52) U.S. Cl. ..... 68/12.06; 68/24

(58) Field of Classification Search ..... 68/23.1, 68/24, 12.06; 8/159
See application file for complete search history.

(56) References Cited

U.S. PATENT DOCUMENTS

| | | | | |
|---|---|---|---|---|
| 5,768,731 | A * | 6/1998 | Do | 8/159 |
| 5,970,555 | A * | 10/1999 | Baek et al. | 8/159 |
| 6,032,494 | A * | 3/2000 | Tanigawa et al. | 68/12.06 |
| 7,000,436 | B2 * | 2/2006 | Peterson | 68/12.04 |
| 7,016,744 | B2 * | 3/2006 | Howard et al. | 700/83 |
| 7,150,167 | B2 * | 12/2006 | Tomigashi et al. | 68/12.04 |
| 7,536,881 | B2 * | 5/2009 | Lorenz et al. | 68/12.06 |
| 2003/0000262 | A1 * | 1/2003 | Bruce et al. | 68/12.06 |
| 2005/0066450 | A1 * | 3/2005 | Weinmann | 8/159 |
| 2005/0115006 | A1 | 6/2005 | Lee et al. | |
| 2005/0116134 | A1 | 6/2005 | Lee et al. | |
| 2006/0010936 | A1 * | 1/2006 | Weinmann et al. | 68/12.02 |
| 2006/0011429 | A1 | 1/2006 | Park et al. | |
| 2006/0053838 | A1 * | 3/2006 | Inuzuka et al. | 68/3 R |
| 2007/0039359 | A1 | 2/2007 | Lee et al. | |

(Continued)

FOREIGN PATENT DOCUMENTS

DE 29 15 815 * 11/1980

(Continued)

OTHER PUBLICATIONS

European Patent Office 1 154 064 Nov. 2001.*

(Continued)

*Primary Examiner* — Frankie L Stinson
(74) *Attorney, Agent, or Firm* — KED & Associates LLP

(57) ABSTRACT

A method for sensing vibration of a washing machine including an outer tub installed within a main body, an inner tub rotatably installed within the outer tub, and a motor that drives the inner tub, includes: distributing the laundry put in the inner tub; sensing actual vibration generated when the motor is acceleratedly operated; sensing unbalance mass generated during the accelerated operation of the motor; comparing the sensed actual vibration and the sensed unbalance mass with a reference vibration and a reference unbalance mass; and driving the motor based on the comparison result of the vibration and the unbalance mass. Thus, an unbalance sensing reference which has been set to be too strict more than necessary to sense an abnormal vibration can be mitigated, and thus, time taken for entering the dewatering stroke can be reduced, and because noise smaller than a reference value is generated by limiting vibration of the washing machine during the normal dewatering operation, an agreeable washing environment can be provided to the user.

8 Claims, 4 Drawing Sheets

U.S. PATENT DOCUMENTS

2009/0151085 A1* 6/2009 Altinier et al. ..... 8/159

FOREIGN PATENT DOCUMENTS

| | | | |
|---|---|---|---|
| DE | 202004005282 | * | 7/2004 |
| GB | 2 174 513 | * | 11/1986 |
| JP | 04-208199 | * | 7/1992 |
| JP | 05-015689 | * | 1/1993 |
| JP | 10-005485 | * | 1/1998 |
| JP | 2002-292179 | * | 10/2002 |
| JP | 2006-116177 | * | 5/2006 |
| KR | 2006025236 | * | 3/2006 |

OTHER PUBLICATIONS

Euorpean Patent Office 1 362 946 Jan. 2003.*

* cited by examiner

APPARATUS AND METHOD FOR SENSING VIBRATION OF WASHING MACHINE

BACKGROUND OF THE INVENTION

1. Field of the Invention

The present invention relates to an apparatus and method for sensing vibrations of a washing machine and, more particularly, to an apparatus and method for sensing vibrations of a washing machine capable of controlling a washing machine based on the actual amount of vibrations generated from the washing machine.

2. Description of the Related Art

In general, a washing machine removes a contaminant from the laundry soaked in a washing solution by applying a proper frictional abrasion or applying a mechanical action such as vibrations to the laundry.

In washing the laundry, the washing machine performs a washing process in which a mechanical force is applied to the laundry mixed in the washing solution, a rinsing process in which the washing solution with contaminant is removed from the laundry, and a dewatering process in which rinse water is removed from the laundry.

The structure and operation of a general drum washing machine will now be described with reference to the accompanying drawings.

FIG. 1 is a front view schematically showing the related art drum washing machine.

As shown in FIG. 1, the related art washing machine includes a housing 10 that supports the configuration of a main body and having a certain space therein; an outer tub 20 installed within the housing 10; an inner tub 30 installed within the outer tub 20 and in which a washing operation is performed; a motor (not shown) installed on a lower surface of the outer tub 20 and driving the inner tub 30; a damper 50 installed at a lower portion of the outer tub 20 and damping vibration which is generated from the outer tub 20 and the inner tub 30 and transferred to the housing 10; and springs 60 installed at upper portions of the outer tub 20.

In the drum washing machine, water is supplied in washing and rinsing laundry, and when water is filled up to a proper water level, water supply is stopped and the motor is driven. Then, the inner tub 30 is repeatedly rotated clockwise and counterclockwise.

In dewatering, the water within the inner tub 30 is drained out, the inner tub 30 is rotated clockwise and counterclockwise at a lower speed by the motor to perform a certain even laundry distribution and then accelerated to perform a regular dewatering stroke.

When the laundry is not evenly distributed within the washing machine so laundry unbalancing or abnormal vibrations occur, severe vibration and noise are generated in the dewatering process.

In order to solve the problem, the related art washing machine calculates an unbalance mass by using variation of an RPM (Revolution Per Minute) during a dewatering stroke and controls the washing machine upon determining whether or not there is an abnormal vibration based on the calculated value.

When an initial unbalance mass is sensed to be high, the rotation is stopped and laundry distribution starts. Also, when the unbalance mass is more than a reference value during the accelerated operation, the rotation is stopped and the laundry distribution is executed again.

However, in the related art washing machine, because the amount of vibrations is not directly measured but abnormal vibrations are sensed by calculating the unbalance mass, a problem arises in that an abnormal vibration may be generated with respect to loads whose unbalance mass is hardly sensed, so the washing machine walks or its inner tub severely collides with the outer tub.

SUMMARY OF THE INVENTION

Therefore, in order to address the above matters the various features described herein have been conceived. One aspect of the exemplary embodiments is to provide an apparatus and a method for sensing vibration of a washing machine capable of controlling the washing machine based on an actual amount of vibration generated from the washing machine, not based on an unbalance mass, to thus solve a problem of a diagonal load that is hardly sensed through the unbalance mass sensing method or other abnormal vibrations.

This specification provides an apparatus for sensing vibration of a washing machine including an outer tub installed within a main body, an inner tub rotatably installed within the outer tub, and a motor that drives the inner tub, that may include: a sensing unit that senses vibration and unbalance mass when the washing machine is acceleratedly operated; and a controller that controls driving of the motor based on the vibration and unbalance mass sensed by the sensing unit.

The sensing unit includes a vibration sensing unit that senses vibrations generated from the outer tub due to the rotation of the inner tub; and an unbalance (eccentricity) sensing unit that senses rotation speed vibration of the inner tub and calculating unbalance mass by using the sensed rotation speed vibration.

This specification also provides a method for sensing vibration of a washing machine including an outer tub installed within a main body, an inner tub rotatably installed within the outer tub, and a motor that drives the inner tub, that may include: distributing the laundry put in the inner tub; sensing actual vibration generated when the motor is acceleratedly operated; sensing unbalance mass generated during the accelerated operation of the motor; comparing the sensed actual vibration and the sensed unbalance mass with a reference vibration and a reference unbalance mass; and driving the motor based on the comparison result of the vibration and the unbalance mass.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The apparatus and method for sensing vibration of a washing machine according to the present invention will now be described in detail with reference to the accompanying drawings.

Figure 1:
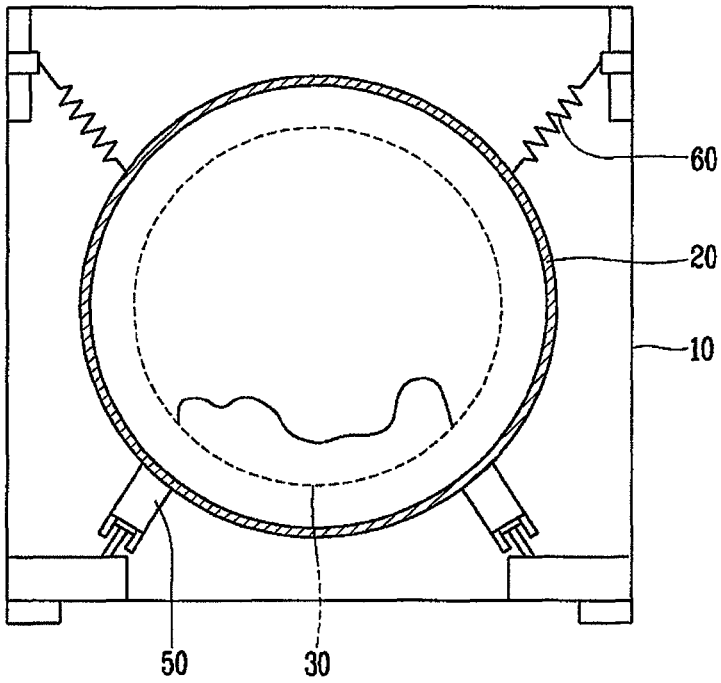
FIG. 1 is a front view schematically showing a drum washing machine according to the related art.
Figure 2:
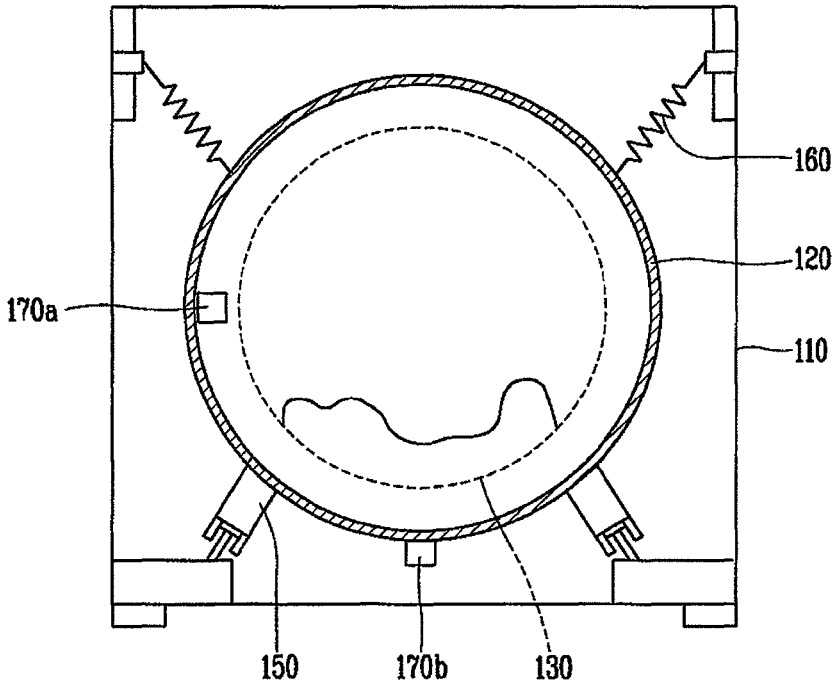
FIG. 2 is a front view schematically showing a washing machine having an apparatus for sensing vibration of the washing machine according to one exemplary embodiment of the present invention.

FIG. 2 is a front view schematically showing a washing machine having an apparatus for sensing vibration of the washing machine according to one exemplary embodiment of the present invention.

With reference to FIG. 2, the washing machine according to the present invention includes: a housing 110 constituting an external appearance of a main body of a washing machine and having a certain space therein, an outer tub 120 installed within the housing 110, an inner tub 130 installed within the outer tub 120 and performing washing, a motor (not shown) rotating the inner tub 130, a damper 50 installed at a lower side of the outer tub 120 and damping vibration generated from the outer tub 120 and the inner tub 130 and then transferred to the housing 110, a spring 60 installed at an upper portion of the outer tub 20, and vibration sensors 170*a* and 170*b* that senses vibration generated according to rotation of the inner tub 130. The washing machine may further include rotation sensor (not shown) that senses rotation of the inner tub 130.

The abnormal vibration sensors 170*a* and 170*b* may be acceleration sensors that can be mounted at positions where abnormal vibrations of the outer tub 120 can be properly sensed. Or only one of the vibration sensors 170*a* and 170*b* may be attached at an optimal location at which several abnormal vibrations can be simultaneously measured. In addition, the vibration sensors 170*a* and 170*b* may sense (measure) abnormal vibrations in 1~3 axis directions, simultaneously, or to sense abnormal vibrations in a single axis direction, selectively.

The rotation sensor is attached on the outer tub 120 to measure rotation speed of the inner tub 130 to thus sense variation of the rotation speed, and includes one or more hall sensors.

Figure 3:
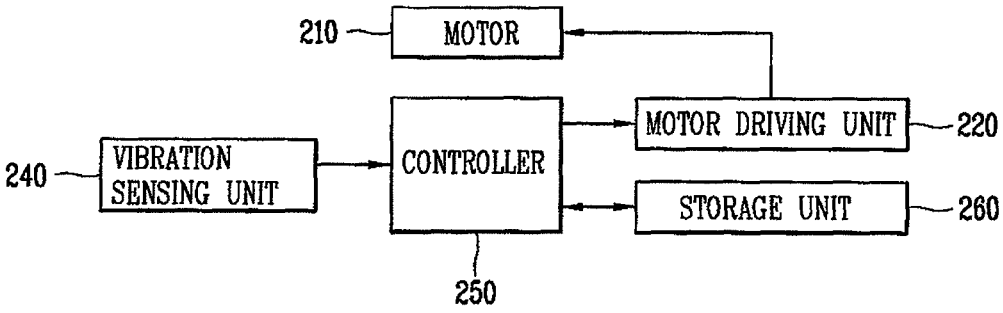
FIG. 3 is a schematic block diagram showing the construction of the washing machine according to one exemplary embodiment of the present invention.

FIG. 3 is a schematic block diagram showing the construction of the washing machine according to one exemplary embodiment of the present invention.

As shown in FIG. 3, an apparatus for sensing vibration of the washing machine according to the present invention includes a motor 210 that generates a driving force to the inner tub 130, a motor driving unit 220 that drives the motor 210 in order to rotate or stop the motor 210; a vibration sensing unit 240 that senses actual vibration generated from the outer tub 120 due to rotation of the inner tub 130 when the washing machine is operated; a controller 250 that controls the motor driving unit 220 according to the sensed vibration; and a storage unit 260 that stores a reference vibration.

The motor 210 applies a mechanical force to rotate the inner tub 130 to allow contaminant to be removed from the laundry. The motor 210 is repeatedly rotated forward and backward alternately at a low speed during a washing and rinsing operation and is rotated in one direction at a high speed during a dewatering operation. Because the motor 210 is alternately rotated forward and backward at the low speed at the initial stage, when the process enters the dewatering operating, the laundry is in an evenly distributed state.

The motor driving unit 220 drives the motor 210 under the control of the controller 250.

The vibration sensing unit 240 senses vibration according to a diagonal load that is hardly sensed by unbalance mass detection (sensing) and other abnormal vibrations and informs the controller 250 accordingly. The vibration sensing unit 240 may include one or more vibration sensors 170*a* and 170*b*, and as the vibration sensors 170*a* and 170*b*, acceleration sensors are used. The acceleration sensors may be mounted at positions where vibration of the outer tub 120 generated according to the rotation of the inner tub 130 is properly measured. Alternatively, only one acceleration sensor may be attached at an optimum position at which several abnormal vibrations can be simultaneously sensed. As shown in FIG. 2, the acceleration sensors 170*a* and 170*b* may be attached at inner and/or outer surfaces of the outer tub 120.

When the acceleration sensors are attached in the three-axis directions of the outer tub 120, the vibration sensing unit 240 measures vibrations generated from the outer tub 120 in 1~3 axis direction, simultaneously, or in a single axis direction, selectively, with respect to the three-axis directions.

The controller 250 controls the motor driving unit 220 according to the vibration measured by the vibration sensing unit 240. If the vibration outputted from the vibration sensing unit 240 is a reference vibration or greater, the controller 250 stops rotating of the motor 210 and performs an operation of distributing the laundry. If, however, the sensed vibration is smaller than the reference vibration, the controller 250 controls the motor driving unit 220 to maintain an accelerated operation state of the motor 210.

The storage unit 260 stores the reference vibration. The reference vibration can be initially measured by the vibration sensing unit 240 or can be arbitrarily set by a user previously.

Figure 4:
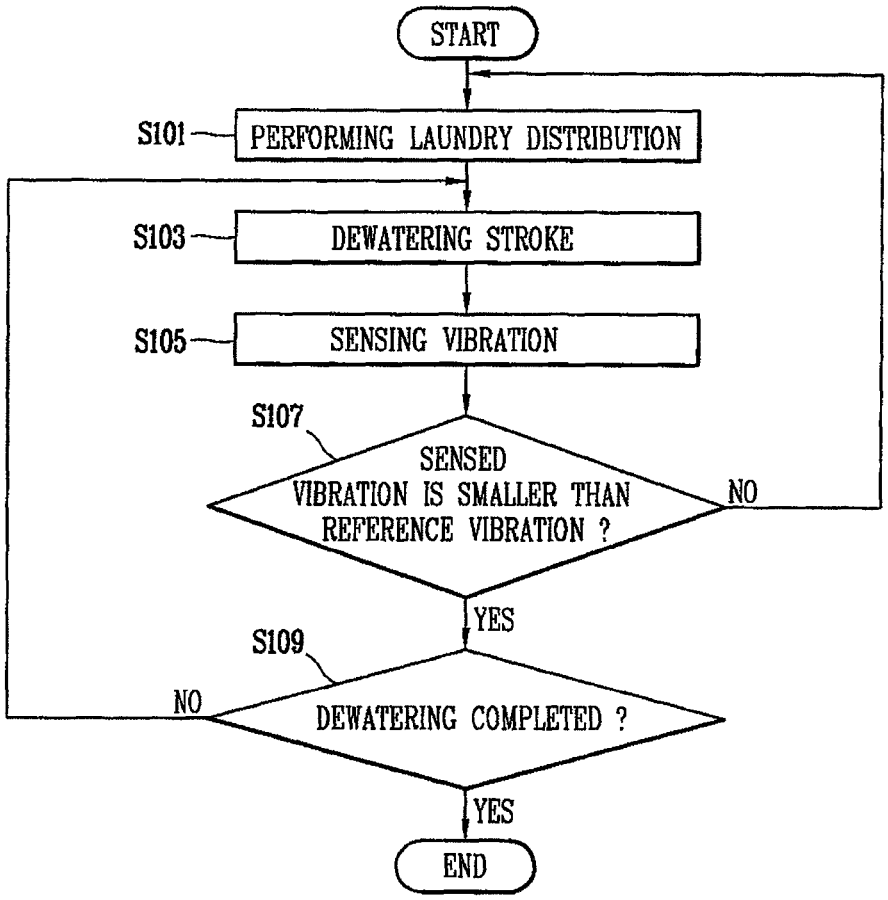
FIG. 4 is a flow chart illustrating the process of a method for sensing vibration of the washing machine according to one exemplary embodiment of the present invention in FIG. 3.

FIG. 4 is a flow chart illustrating the process of a method for sensing vibration of the washing machine according to one exemplary embodiment of the present invention in FIG. 3. The method for sensing vibration of the washing machine will now be described in detail with reference to FIG. 4.

As shown in FIG. 4, when the washing machine enters the dewatering stroke, first, the controller 250 of the washing machine controls the motor driving unit 220 to drive the motor 210 to allow the inner tub 130 to be rotated alternately forward and backward at the low speed so that the laundry put in the inner tub 130 can be evenly distributed (S101). When the laundry put in the inner tub 130 is evenly distributed according to the laundry distribution, the controller 250 accelerates the motor 210 by means of the motor driving unit 220 to perform the full-scale dewatering operation (S103). In this case, the motor 210 is accelerated in one direction under the control of the motor driving unit 220 so as to be rotated at the high speed.

When the motor 210 is acceleratedly operated, the controller 250 senses actual vibration generated from the outer tub 120 according to the rotation of the inner tub 130 through the vibration sensing unit 240 (S105). In this case, the vibration sensing unit 240 simultaneously or selectively senses vibration generated from the washing machine through one or more acceleration sensors installed at the outer tub 120 of the washing machine with respect to one or more axial directions. In addition, the vibration sensing unit 240 may be installed at every position of the outer tub 120 where an abnormal vibration is generated or only single vibration sensing unit may be installed only at an optimum position where several abnormal vibrations can be simultaneously measured. Alternatively, multiple acceleration sensors may be attached at every position where abnormal vibration is to be measured, and the driving of the motor 210 may be controlled according to an average value of vibration sensed by the respective acceleration sensors.

The controller 250 compares the sensed vibration with the reference vibration stored in the storage unit 260 (S107). The reference vibration may be vibration sensed initially by the vibration sensing unit 240 or may be previously set by a user or a manufacturer.

Upon comparison (S105), when the sensed vibration is the reference vibration or greater, the controller 250 stops rotating of the motor 210 and performs laundry distribution (S101). In other words, the controller 250 controls the motor driving unit 220 to alternately rotate the motor 210 forward and backward at the low speed so that the laundry put in the inner tub 130 can be evenly distributed.

When the laundry put in the inner tub 130 is distributed evenly, the controller 250 resumes the dewatering stroke by acceleratedly operating the motor 210 by means of the motor driving unit 220 (S103).

When the vibration sensed in step S107 is smaller than the reference vibration, the controller 250 checks whether the dewatering stroke has been completed (S109), and when the dewatering stroke is completed, the controller 250 stops rotating of the motor 210.

When the dewatering stroke has not been completed in step S109, the controller 250 maintains the accelerated operation of the motor 210 to perform the dewatering stroke (S103).

Figure 5:
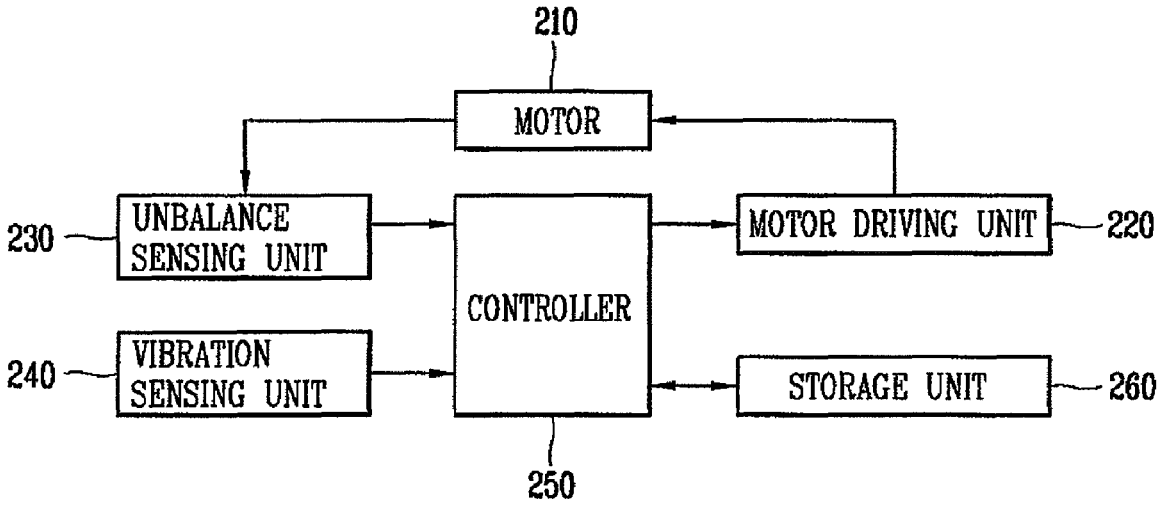
FIG. 5 is a schematic block diagram showing the construction of the washing machine according to another exemplary embodiment of the present invention.

FIG. 5 is a schematic block diagram showing the construction of the washing machine according to another exemplary embodiment of the present invention.

With reference to FIG. 5, the apparatus for sensing vibration of the washing machine according to the present invention includes the motor 210 that generates a driving force to the inner tub 130, the motor driving unit 220 that drives the motor 210 in order to rotate or stop the motor 210; an unbalance sensing unit 230 that senses an unbalance mass when the washing machine is acceleratedly operated; the vibration sensing unit 240 that senses actual vibration generated from the outer tub 120 due to rotation of the inner tub 130 when the washing machine is operated; the controller 250 that controls the motor driving unit 220 according to the sensed vibration; and the storage unit 260 that stores a reference vibration.

The motor driving unit 220 drives the motor 210 under the control of the controller 250. For example, when performing the laundry distribution, the motor driving unit 220 alternately drives the motor 210 forward and backward while operating the motor 210 at the low speed. When performing the dewatering operation, the motor driving unit 220 acceleratedly operates the motor 210 so as to be rotated at the high speed under the control of the controller 250.

The unbalance sensing unit 230 includes one or more hall sensors that sense the rotation speed of the inner tub 130 and a calculation unit (not shown) that calculates the unbalance mass by using variation of the rotation speed, during the dewatering stroke. In the present exemplary embodiment, the unbalance sensing unit 230 calculates the unbalance mass through the variation of the rotation speed, but without being limited thereto, the unbalance sensing unit 230 may sense only the rotation speed of the inner tub 130 and transmit it to the controller 250, and then, the controller 250 may calculate the unbalance mass by using the variation of the sensed rotation speed.

The vibration sensing unit 240 serves to sense vibration according to a diagonal load that is hardly sensed through the unbalance load sensing and other abnormal vibrations. The vibration sensing unit 240 may include one or more acceleration sensors. The acceleration sensor may be attached at every position one by one where an abnormal vibration generated from the outer tub 120 of the washing machine may be properly measured. Alternately, only one acceleration sensor may be attached at an optimum position at which several abnormal vibrations can be measured. In addition, the acceleration sensors may be attached at inner or outer surface of the outer tub 120 of the washing machine as shown in FIG. 2.

When the acceleration sensors are attached in several axis directions of the outer tub 120, the vibration sensing unit 240 may simultaneously or selectively measure the vibration generated from the washing machine with respect to the several axis directions. For example, when the acceleration sensors are attached in the three-axis directions of the outer tub 120, the vibration sensing unit 240 measures vibrations generated from the outer tub 120 in 1~3 axis direction, simultaneously, or in a single axis direction, selectively, with respect to the three-axis directions. Or, the vibration sensing unit 240 sequentially measures the vibration with respect to the three-axis directions.

The controller 250 controls the motor driving unit 220 according to the vibration and the unbalance mass measured by the vibration sensing unit 240 and the unbalance sensing unit 230 to drive the motor 210. When the vibration sensed by the vibration sensing unit 240 is the reference vibration or greater, or when the unbalance mass sensed by the unbalance sensing unit 230 is the reference unbalance mass or greater, the controller 250 stops rotating of the motor 210 and performs the operation of distributing the laundry.

In addition, when the vibration and the unbalance mass sensed by the vibration sensing unit 240 and the unbalance sensing unit 230 are the reference vibration or greater or the reference unbalance mass or greater, the controller 250 stops the motor 210 and performs the laundry distribution.

If, however, the sensed vibration and the sensed unbalance mass are smaller than the reference vibration or the reference unbalance mass, the control 250 controls the motor driving unit 220 to allow the maintain the motor 210 to maintain its accelerated operation.

The storage unit 260 stores the reference vibration and the reference unbalance mass. The reference vibration can be a vibration initially measured by the vibration sensing unit 240 or may be previously set by the user or a manufacturer.

In addition, the storage unit 260 stores an application for controlling the operation of the motor according to the sensed vibration and the unbalance mass.

Figure 6:
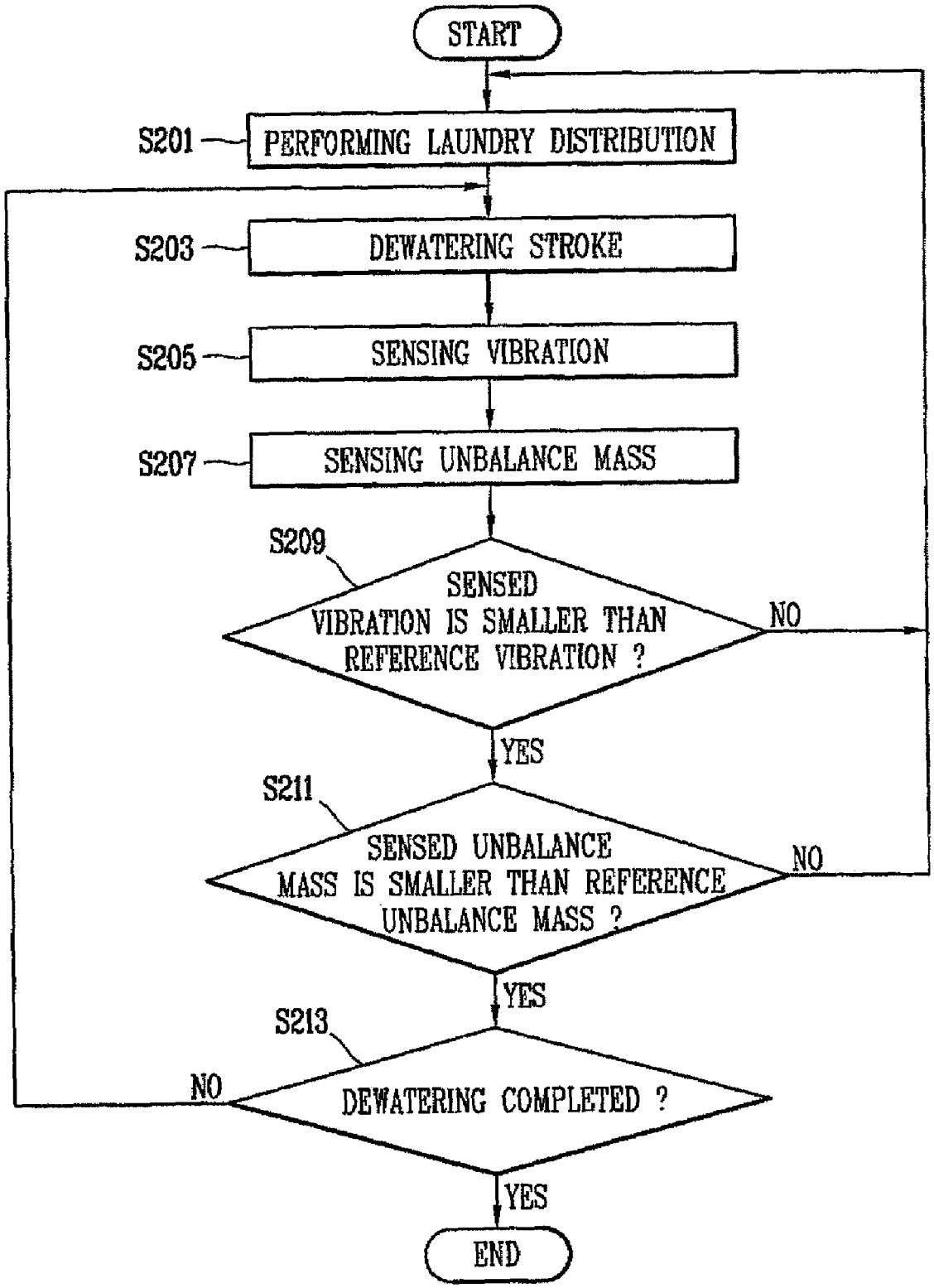
FIG. 6 is a flow chart illustrating the process of a method for sensing vibration of the washing machine according to another exemplary embodiment of the present invention in FIG. 5.

FIG. 6 is a flow chart illustrating the process of a method for sensing vibration of the washing machine according to another exemplary embodiment of the present invention in FIG. 5.

As shown in FIG. 6, when the washing machine enters the dewatering operation, the controller 250 of the washing machine controls the motor driving unit 220 to allow the inner tub 130 to be alternately rotated forward and backward at the low speed so that the laundry put in the inner tub 130 to be uniformly distributed (S201). After the laundry distribution, the controller 250 accelerates the motor 210 through the motor driving unit 220 to rotate the motor at the high speed to perform full-scale dewatering stroke (S203). Because the inner tub 130 is rotated by the motor 210, washing water contained in the laundry put in the inner tub 130 can be removed according to the centrifugal force, dewatering the laundry.

When the motor 210 is acceleratedly operated, the controller 250 senses actual vibration generated from the outer tub 120 through the vibration sensing unit 240 (S205). In this case, the vibration sensing unit 240 simultaneously or selectively senses vibration generated from the washing machine through one or more acceleration sensors installed at the outer tub 120 of the washing machine with respect to one or more axial directions. The acceleration sensors may be attached on every suitable position where the vibration of the washing machine can be measured, or only a single acceleration sensor may be installed on an optimum position at which several abnormal vibrations can be measured.

When the motor 210 is acceleratedly operated, the controller 250 senses an unbalance mass generated from the washing machine through the unbalance moss sensing unit 230 (S207). In this case, the unbalance sensing unit 230 senses the rotation speed of the inner tub 130 through the hall sensor installed at the outer tub 120 of the washing machine and calculates the unbalance mass by using the variation of the sensed rotation speed.

The controller 250 compares the sensed vibration with the reference vibration stored in the storage unit 260 (S209). Here, the reference vibration may be vibration sensed initially by the vibration sensing unit 240 or may be previously set by the user or the manufacturer.

When the vibration sensed in the step S209 is the reference vibration or greater, the controller 250 stops rotating of the motor 210 and performs laundry distribution (S201).

When the vibration sensed in step S209 is smaller than the reference vibration, the controller 250 compares the sensed unbalance mass with the reference unbalance mass stored in the storage unit 260 (S211). When the sensed unbalance mass is the balance unbalance mass or greater, the controller 250 stops rotating of the motor 210 and performs the laundry distribution (S201).

If, however, the sensed unbalance mass is smaller than the reference unbalance mass, the controller 250 checks whether the dewatering stroke has been completed (S213). When the dewatering stroke is completed, the controller 250 stops driving of the motor 210.

When the dewatering stroke has not been completed, the controller 250 maintains the accelerated operation of the motor 210 to perform the dewatering stroke.

In other words, in the washing according to the present exemplary embodiment, when one or more of the sensed vibration and the sensed unbalance mass are the reference value or greater, the operation of the motor 210 is stopped and the laundry distribution is performed.

As so far described, the apparatus for sensing vibration of the washing machine according to the present invention has the following advantages.

That is, because actual vibration according to the rotation of the motor of the washing machine can be directly measured by using the vibration sensor mounted at the outer tub of the washing machine, the diagonal load that can be hardly sensed through the unbalance (eccentricity) sensing or any abnormal vibration can be sensed to thus prevent occurrence of the phenomenon that the washing machine walks or the inner tub severely collides with the cabinet.

In addition, because the vibration sensor can sense vibration that cannot be sensed by the hall sensor, the unbalance sensing reference, which has been set to be too strict more than necessary to sense an abnormal vibration, can be mitigated, and thus, time taken for entering the dewatering stroke can be reduced.

Moreover, because noise smaller than a reference value is generated by limiting vibration of the washing machine during the normal dewatering operation, an agreeable washing environment can be provided to the user.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An apparatus for sensing vibration of a washing machine including an outer tub installed within a main body, an inner tub rotatably installed within the outer tub, and a motor that drives the inner tub, the apparatus comprising:

a sensing unit that senses vibration and unbalance mass when the washing machine is acceleratedly operated, the sensing unit including a vibration sensing unit that senses vibration generated from the outer tub due to rotation of the inner tub, and an unbalance sensing unit that senses rotation speed vibration of the inner tub and that calculates unbalance mass by using the sensed rotation speed vibration, wherein the vibration and the unbalance mass sensed by the sensing unit is used for performing laundry distribution for distributing the laundry put in the inner tub, wherein the vibration sensing unit includes one or more acceleration sensors installed on inner and outer surfaces of the outer tub, and the vibration sensing unit simultaneously or selectively senses the vibrations generated from the outer tub in three-axis directions; and a controller that controls driving of the motor based on the vibration and the unbalance mass sensed by the sensing unit, wherein the controller compares the sensed vibration and the sensed unbalance mass with a reference vibration and a reference unbalance mass, and controls operation of the motor to perform the laundry distribution for distributing laundry put in the inner tub or maintain accelerated operation of the motor, wherein when one or more of the sensed vibration and the sensed unbalance mass are the reference vibration or greater and the reference unbalance mass or greater, the controller stops rotating of the motor and performs the laundry distribution, and when the sensed vibration and the sensed unbalance mass are less than the reference vibration and the reference unbalance mass, the controller maintains the accelerated operation of the motor.

2. The apparatus of claim 1, wherein the vibration sensing unit senses vibration according to a diagonal load that is hardly sensed by the unbalance sensing unit and an abnormal vibration.

3. The apparatus of claim 1, wherein the unbalance sensing unit comprises one or more hall sensors installed at the outer tub to sense a rotation speed.

4. The apparatus of claim 3, wherein the unbalance sensing unit calculates unbalance mass by using variation of the rotation speed sensed by the hall sensor.

5. A method for sensing vibration of a washing machine including an outer tub installed within a main body, an inner tub rotatably installed within the outer tub, and a motor that drives the inner tub, the method comprising:

distributing laundry put in the inner tub;

sensing actual vibration generated when the motor is acceleratedly operated;

sensing unbalance mass generated during the accelerated operation of the motor;

comparing the sensed actual vibration with a reference vibration;

comparing the sensed unbalance mass with a reference unbalance mass; and controlling the motor based on the comparison result of the vibration and the comparison result of the unbalance mass, wherein controlling the motor comprises stopping rotation of the motor and distributing the laundry when the sensed actual vibration is a reference vibration or greater or when the sensed unbalance mass is a reference unbalance mass or greater, and maintaining the accelerated operation of the motor when the sensed actual vibration and the sensed unbalance mass are less than the reference vibration and the reference unbalance mass, and wherein, in sensing the vibration, vibration according to a diagonal load is sensed by an acceleration sensor according to an unbalance sensing method and an abnormal vibration.

6. The method of claim 5, wherein, in sensing the vibration, the vibration is sensed through the acceleration sensor mounted at every position at which an abnormal vibration of the outer tub can be measured, or through the acceleration sensor mounted at an optimum position at which multiple abnormal vibrations can be simultaneously sensed.

7. The method of claim 5, wherein, in sensing the vibrations, the vibrations generated from the washing machine are simultaneously or selectively sensed in three-axis directions.

8. The method of claim 5, wherein, in sensing the unbalance mass, variation of a rotation speed of the inner tub through one or more hall sensors attached at the outer tub.

* * * * *